US008888403B2

(12) United States Patent
Atherton

(10) Patent No.: US 8,888,403 B2
(45) Date of Patent: Nov. 18, 2014

(54) COMBINATION GRAVEL SPREADER/PAVER GEO-TEXTILE FABRIC INSTALLER APPARATUS

(76) Inventor: Dwayne L. Atherton, Spring Bay, IL (US)

( * ) Notice: Subject to any disclaimer, the term of this patent is extended or adjusted under 35 U.S.C. 154(b) by 0 days.

(21) Appl. No.: 13/462,312

(22) Filed: May 2, 2012

(65) Prior Publication Data

US 2012/0282026 A1 Nov. 8, 2012

Related U.S. Application Data

(60) Provisional application No. 61/483,233, filed on May 6, 2011.

(51) Int. Cl.

| | |
|---|---|
| ***E01C 19/15*** | (2006.01) |
| ***E01C 19/20*** | (2006.01) |
| ***E01C 23/03*** | (2006.01) |
| ***E01C 19/48*** | (2006.01) |

(52) U.S. Cl.

CPC ..... *E01C 19/15* (2013.01); *E01C 23/03* (2013.01); *E01C 19/4866* (2013.01)

USPC ..... 404/108; 404/110

(58) Field of Classification Search

USPC ..... 404/101, 102, 105, 108, 110; 298/24; 172/272, 273, 274, 834

See application file for complete search history.

(56) References Cited

U.S. PATENT DOCUMENTS

| | | | | |
|---|---|---|---|---|
| 1,029,894 | A * | 6/1912 | Schellenger | 404/108 |
| 1,946,819 | A | 2/1934 | Stevenson | |
| 2,842,036 | A * | 7/1958 | Overman | 404/110 |
| 2,899,877 | A * | 8/1959 | Phillips et al. | 404/110 |
| 2,962,947 | A * | 12/1960 | MacDonald | 404/108 |
| 3,091,999 | A | 6/1963 | MacDonald | |
| 3,108,517 | A * | 10/1963 | Fingland | 404/110 |
| 3,373,669 | A * | 3/1968 | Schmitz | 404/110 |
| 4,175,496 | A | 11/1979 | Rehbein | |
| 4,806,043 | A | 2/1989 | Fournier | |
| 5,059,062 | A * | 10/1991 | Bresnahan | 404/110 |
| 5,620,281 | A | 4/1997 | Lammers et al. | |
| 5,765,967 | A | 6/1998 | Klaymar | |
| 6,050,744 | A * | 4/2000 | Binning | 404/108 |
| 6,203,244 | B1 * | 3/2001 | Van Ornum | 404/110 |
| 6,558,079 | B1 | 5/2003 | Kozak et al. | |
| 6,558,080 | B2 | 5/2003 | Kozak | |
| 7,686,537 | B2 | 3/2010 | Mullett | |
| 7,771,138 | B2 * | 8/2010 | Musil | 404/86 |
| 8,079,778 | B2 | 12/2011 | Colkitt | |

* cited by examiner

*Primary Examiner* — Gary Hartmann

(74) *Attorney, Agent, or Firm* — Garvey, Smith, Nehrbass & North, L.L.C.; Gregory C. Smith; Julia M. FitzPatrick

(57) ABSTRACT

A gravel spreader/paver apparatus and method for transporting and spreading gravel and other base materials, onto a surface, such as a roadway, including a hopper portion for receiving base material from a separate machine, such as a dump truck; attachment brackets for attaching the apparatus to machinery for providing movement to the apparatus; a roll of geo-textile fabric secured onto the apparatus; base material, such as gravel, in the hopper portion for being delivered on the geo-textile fabric as the fabric is unrolled from the apparatus while the apparatus is moving forward; an adjustable moldboard mounted on the apparatus for spreading the base material to a pre-determined, precise depth; the moldboard adjustable to multiple positions, to control the amount, depth, and width of the material being spread; adjustable plates for allowing the base material to be spread onto the sub-base at predetermined widths, depths and slopes.

14 Claims, 12 Drawing Sheets

COMBINATION GRAVEL SPREADER/PAVER GEO-TEXTILE FABRIC INSTALLER APPARATUS

CROSS-REFERENCE TO RELATED APPLICATIONS

Priority of U.S. Provisional Patent Application Ser. No. 61/483,233, filed May 6, 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to gravel spreader/paver apparatuses. More particularly, the present invention relates to an apparatus for transporting and spreading of various materials such as gravel, limestone, asphalt, dirt, concrete, sand with the application of a geo-textile fabric installer attachment thereto.

2. General Background of the Invention

Applicant is attaching hereto an Information Disclosure Statement which relates to patents found in the art. However, there appears to be no prior art which teaches or relates to a spreader/paver, which solved the problems encountered in the area of constructing roads, bike paths and other infrastructures. Many construction engineers' specifications have a requirement for geo-textile fabric to be installed over the prepared sub-base before the base material can be spread over it to a specified depth. The problem encountered is that once the geo-textile fabric has been placed, it must not have any contact with the tire or tracks of any machine that may be used to spread or transport the base material. An additional problem is that it usually takes an extra crew of labor to place the fabric in place and, due to the fact that no tires or tracks may come into contact with the fabric, smaller sections are usually done at a time costing additional money and time to be added to the overall job. Another problem in the construction process is that all equipments maneuverability becomes greatly limited due to the requirement that equipment cannot come in direct contact with the geo-textile fabric at any stage of the construction process. An additional problem in the construction process is that the base material must be spread to a certain depth and width in order to meet certain specification requirements, and the process currently being used has no accurate means of spreading base materials to a precise depth and width. These problems, along with others not listed, cause most contractors to use more expensive equipment to meet the required specifications and make the construction process very inefficient, costly and time consuming. Therefore, there is a need in the art for a combination gravel spreader/paver apparatus which can accomplish the task heretofore not accomplished by the prior art.

The following U.S. patents are incorporated herein by reference:

| Pat. No. | Title | Issue Date |
|---|---|---|
| 1,946,819 | Machine for Curing Concrete | Feb. 13, 1934 |
| 2,962,947 | Road Base Spreading Apparatus | Dec. 06, 1960 |
| 3,091,999 | Base Spreader | Jun. 04, 1963 |
| 4,175,496 | Earth Working Implement | Nov. 27, 1979 |
| 4,806,043 | Method and Device for All Stabilized Civil Engineering Areas or of Adjacent Borders of a Structure | Feb. 21, 1989 |
| 5,620,281 | Machine and Method for Laying Film on Face of Landfill | Apr. 15, 1997 |
| 5,765,967 | Method and Apparatus for Backfilling Pipeline Trenches | Jun. 16, 1998 |
| 6,558,079 | Method and Apparatus for Covering Landfill | May 06, 2003 |
| 6,558,080 | Method and Compact Apparatus for Covering Landfill | May 06, 2003 |
| 7,686,537 | Road Grader/Spreader | Mar. 30, 2010 |
| 8,079 778 | Geo-textile Applicator Device and Method | Dec. 20, 2011 |

BRIEF SUMMARY OF THE INVENTION

The apparatus of the present invention solves the problems in the road, bike path, infrastructure construction process in a simple and straightforward manner. What is provided is a gravel spreader/paver and geo-textile fabric installing apparatus capable of being used to transport and spread gravel and other materials and/or able to be used to transport and spread gravel while the apparatus installs geo-textile fabric when such fabric is required in the construction process. What is provided is a universal hitch assembly having multiple adjustment tubes and brackets mounted on the apparatus which allows the apparatus to be attached to and operated by a wide variety of commonly used machines a contractor would normally have at his disposal, eliminating the need for more expensive, specialized machines. The present invention, when used as intended, will place the geo-textile fabric on the sub-base while transporting and spreading the base material on top of the fabric to a pre-determined, precise depth, width, and slope by use of adjustable moldboards and various plate assemblies, such as, strike-off plates, extension plates and cutoff plates. When the apparatus is attached to a skid steer or other machine, the base material can be loaded into a hopper by a dump truck or other machine. When utilizing a truck, the apparatus would be positioned in front of the spreader/paver and dumping the base material into the hopper while in motion. The skid steer in this case would give the spreader/paver and dump truck its forward motion. When using the wheel locks of the spreader/paver, the dump truck would dump the base material in the hopper while in motion without a skid steer or other machine needed, whereas the dump truck would be used for the motion and use of the spreader/paver. This would be achieved by using the spreader/payer's wheel locks to attach and latch onto a dump truck or similar machine's rear wheels to serve as a method of operating the spreader/paver by giving the motion needed for the apparatus to perform and operate.

Therefore, it is object of the present invention to provide an apparatus for transporting and spreading of various materials such as, but not limited to gravel, limestone, asphalt, dirt, sand, etc.;

It is a further object of the present invention to provide a combination apparatus material transporter, spreader, paver, and geo-textile fabric installer attachment apparatus;

It is a further object of the present invention to provide a spreader/paver apparatus having a hopper for the means of transporting and distributing base materials;

It is a further object of the present invention to provide a spreader/paver attachment having one or more universal hitches which allow a wide variety of machines to attach to and operate the gravel spreader/paver apparatus, such as, but not limited to a skid steer, back hoe, dozer, dump truck, etc.;

It is a further object of the present invention to provide a spreader/paver attachment with one or more adjustable moldboards able to adjust into multiple positions, such as heights, widths and slopes, which gives the operator control of the amount, depth, width and slope of the material being spread;

It is a further object of the present invention to provide an apparatus which may be achieved manually and/or by other force such as hydraulic, mechanical/electrical actuator, mechanically or by pneumatic power;

It is a further object of the present invention to provide a spreader/paver attachment having adjustable extension plate assemblies extending out one or more sides of the apparatus which may be adjusted into a wide variety of configurations for spreading various widths, heights, and slopes that an operator may commonly encountered during the construction of roads, bike paths, and similar infrastructure;

It is a further object of the present invention to provide the above object by manually or by other force such as hydraulic, mechanical/electrical actuator, mechanically or by pneumatic power;

It is a further object of the present invention to, provide a spreader/paver which may have one or more adjustable wheels and/or screeds to come into contact with the base material being spread after it has been ejected from the hopper in order to redistribute weight from the hopper to the ground;

It is a further object of the present invention to provide a gravel spreader/paver containing wheel lock assemblies for attaching the gravel spreader/paver apparatus to dump trucks or similar machines therefore allowing dump trucks to provide the gravel spreader/paver the needed motion and power intended operation and use;

It is a further object of the present invention to provide a spreader/paver designed of a compact size and weight to be of ease to transport from job to job site on a standard sized equipment trailer and to be transported by light truck or other vehicle.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

FIGS. 1 through 23 illustrate the gravel spreader/paver and geo-textile fabric installer apparatus of the present invention, also referred to as the spreader/paver apparatus 10, or even more simply as apparatus 10. The gravel spreader/paver and geo-textile fabric installer apparatus 10 can be utilized as either a gravel base spreader or as a combination gravel base spreader and fabric installer when fabric is required. It may of course have other uses in the industry.

Figure 1:
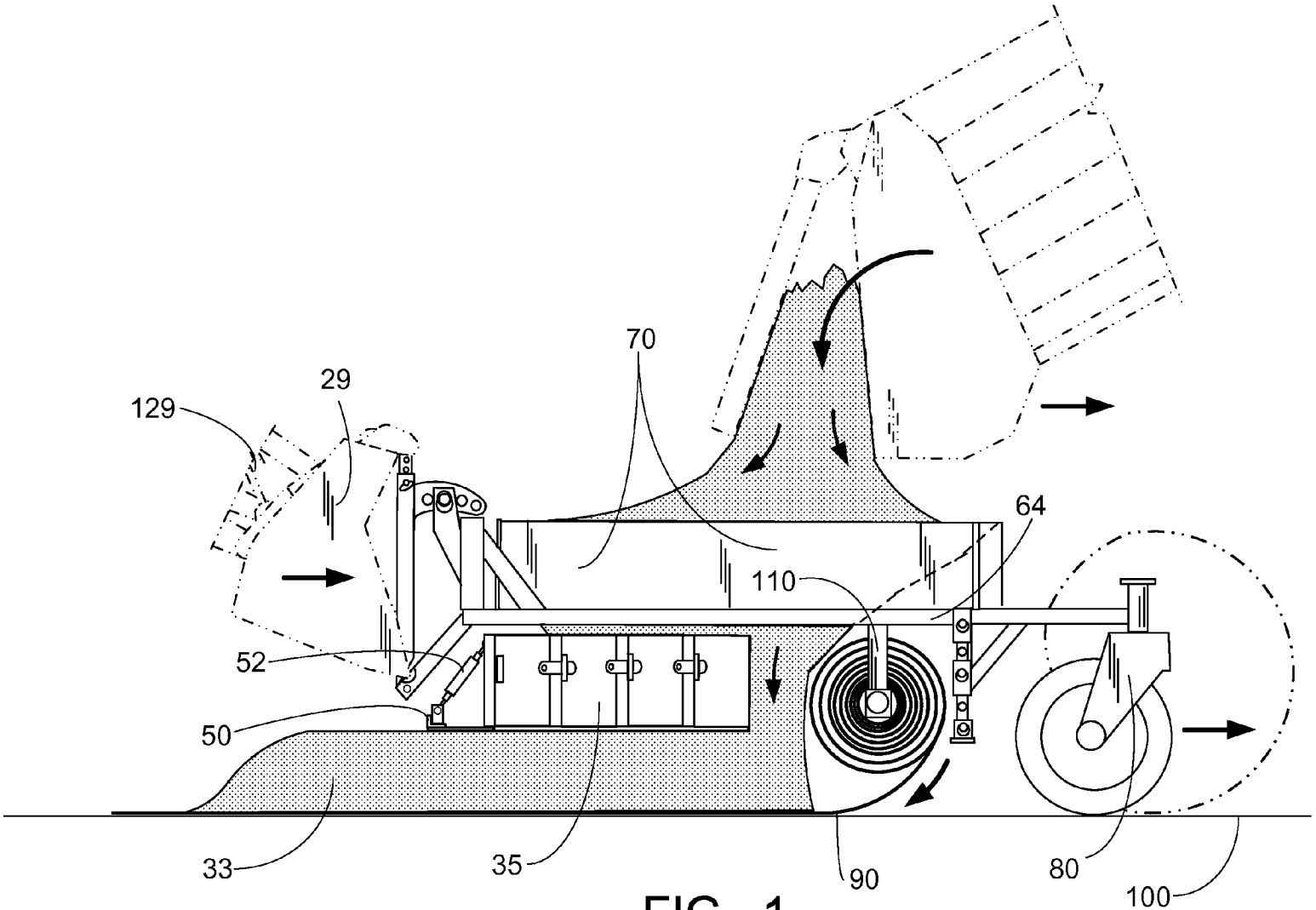
FIGS. 1 and 1A illustrate cutaway side views of the preferred embodiment of the spreader/paver apparatus of the present invention receiving materials from a dump truck.
Figure 1A:
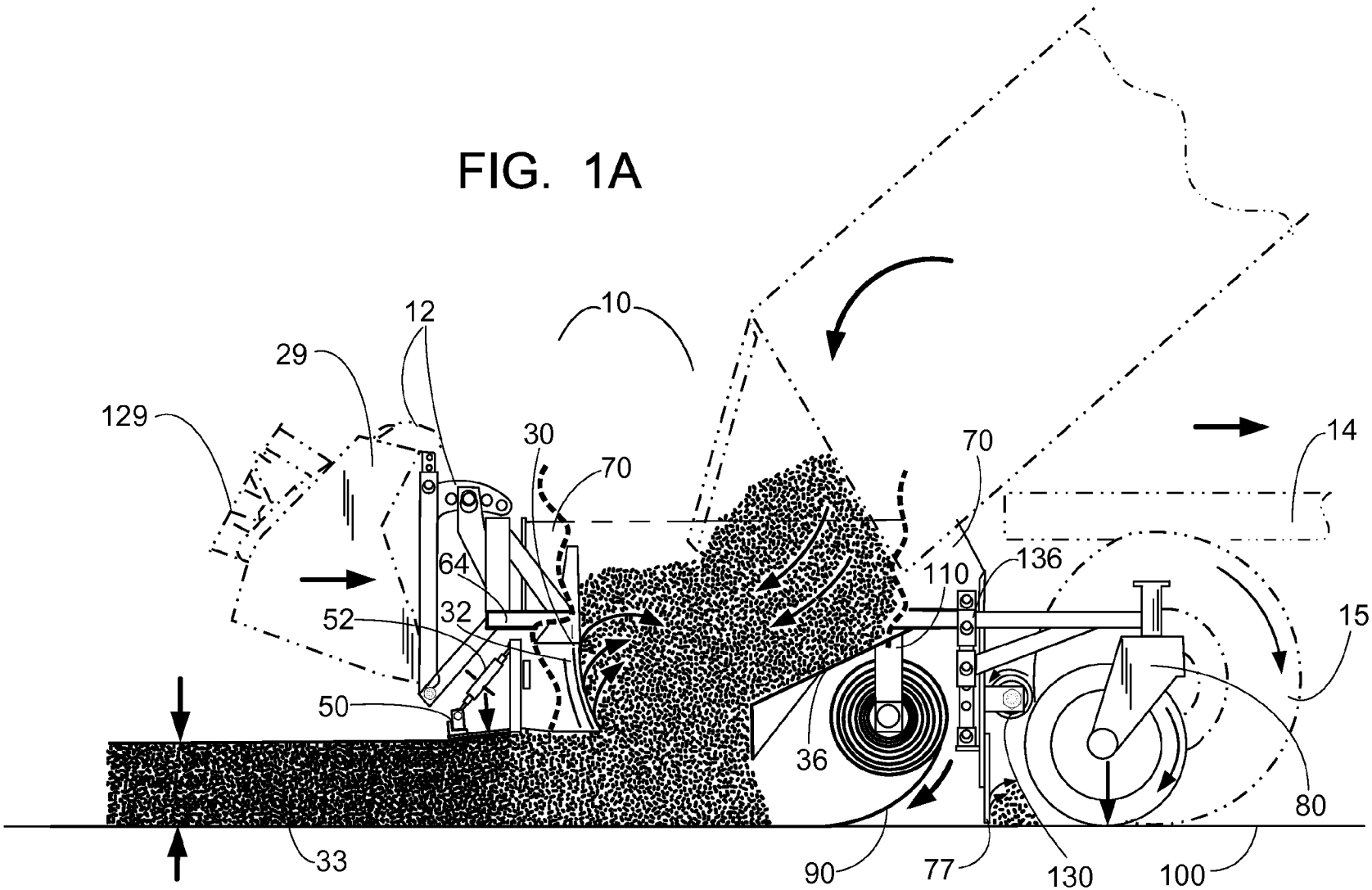
Figure 2:
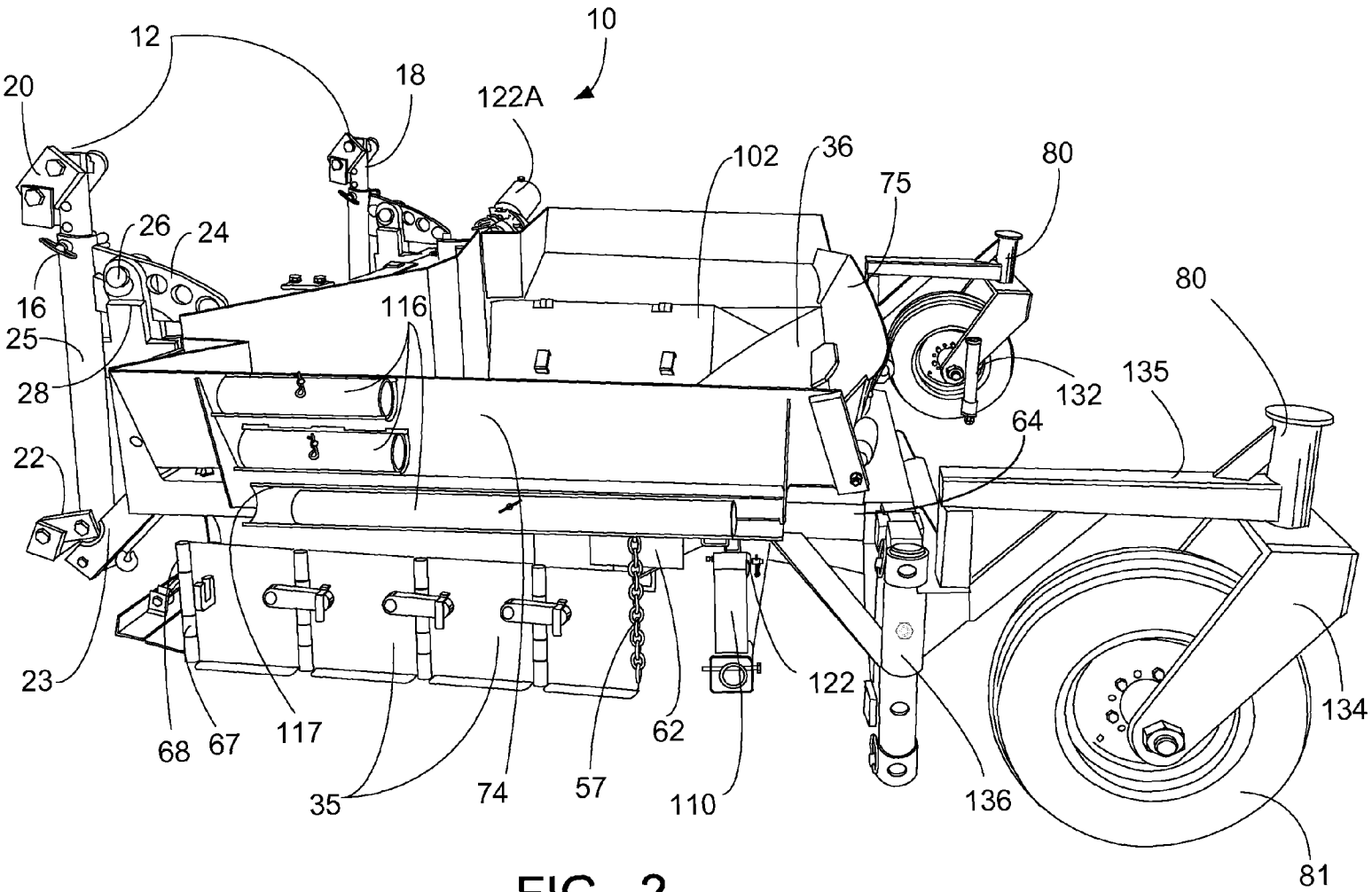
FIG. 2 illustrates an overall view of the preferred embodiment of the spreader/paver apparatus of the present invention.

The gravel/spreader apparatus 10 would be equipped with a universal hitch assembly 12, as illustrated in FIGS. 1A, 2, 6 and 7, which allows the gravel spreader/paver apparatus 10 to attach to and be operated by a wide variety of machines, including but not limited to skid steers, wheel loaders, and dozers 129. This hitch assembly 12 is adjustable for different height blades and buckets by removing pin 16 and raising or lowering vertical adjustment tube 18, as illustrated in FIG. 2. A chain and binder are hooked into upper and lower hitch brackets 20 and 22, and vertical support tube bracket 23 and vertical support tube 25 as illustrated more clearly in FIGS. 6, 7, and 2. In operation, the chain would wrap around the bucket or blade 29, and once the binder is tightened, these brackets 20, 22 serve as a clamp device. Horizontal pitch adjustment bracket 24 allows the pitch of the hitch assembly 12 to be adjusted to fit different dozer blades and buckets 29, as illustrated in FIG. 2. This can be accomplished by removing locking pin 26 from locking bracket 28 and then rotating the hitch assembly 12 to the preferred pitch before reinserting the locking pin 26 through the corresponding hole of the pitch adjustment bracket 24, as illustrated in FIG. 2. The pitch adjustment of the hitch assembly 12 is particularly useful when attaching the gravel spreader/paver 10 to dozers, whereas most dozer blades have no vertical tilt capabilities, such as skid steers, backhoes, and wheel loaders.

Figure 4:
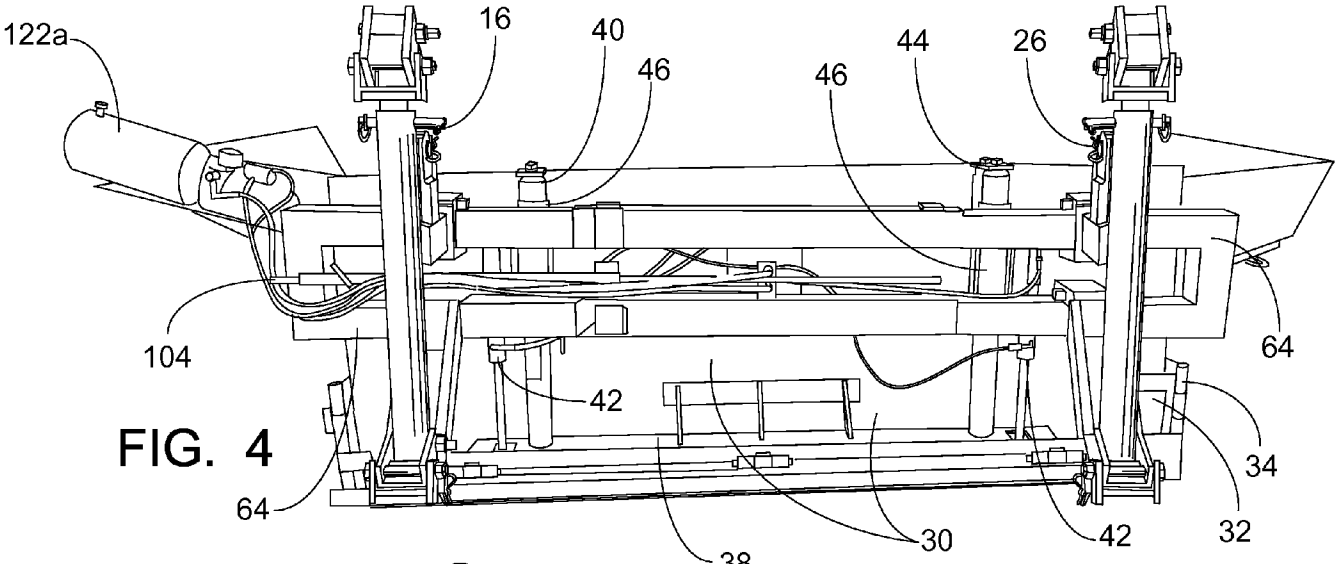
FIG. 4 illustrates a rear view of the spreader/paver apparatus of the present invention.
Figure 14:
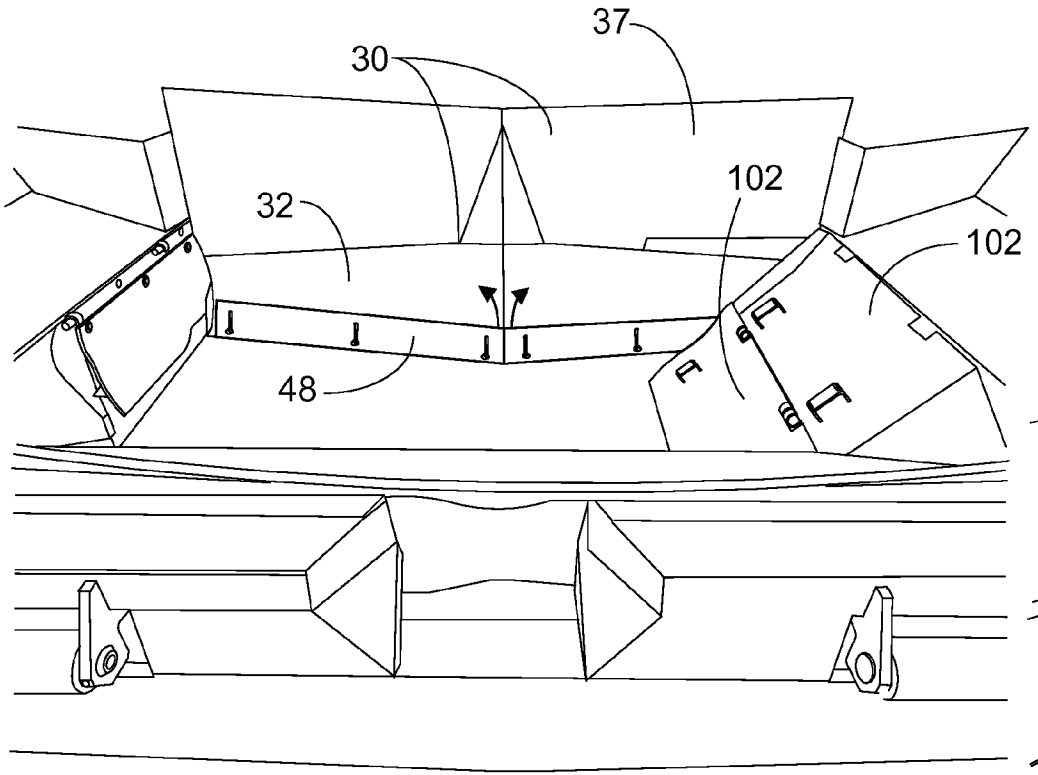
FIG. 14 illustrates a view of the adjustable moldboard assembly and cutoff plate inserts of the spreader/paver apparatus of the present invention.
Figure 17:
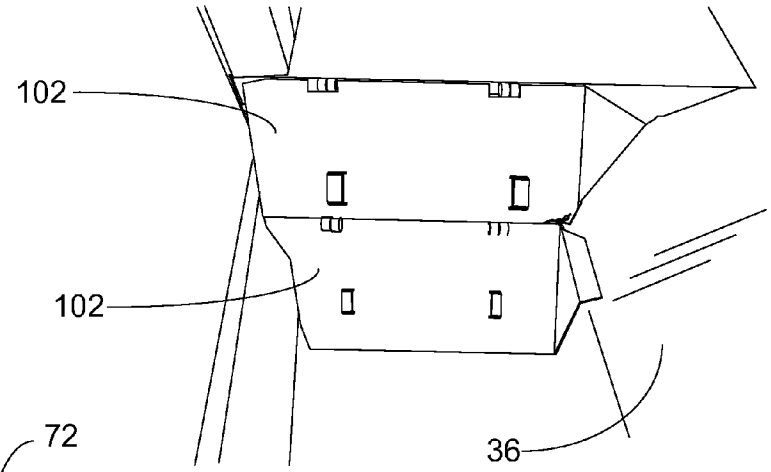
FIG. 17 illustrates views of the upper cut-off plate insert and extension pin insert of the spreader/paver apparatus of the present invention.
Figure 18:
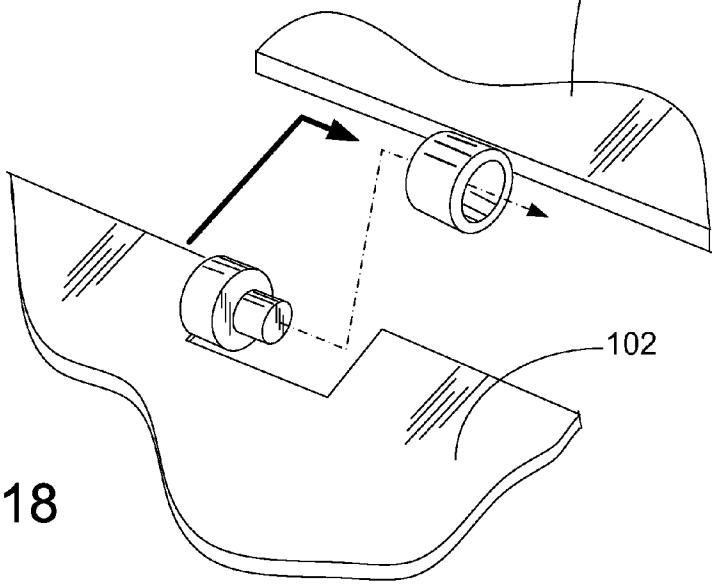
FIG. 18 illustrates a view of the hopper insert latch engaging the upper cut-off plate insert to the inner hopper plate of the spreader/paver apparatus of the present invention.

Reference is now made to FIGS. 1A, 4 and 14, which illustrate the adjustable moldboard assembly 30, also referred to as assembly 30. Assembly 30 can be raised or lowered vertically within the spreader apparatus 10 in order to spread different depths of base material 33, as illustrated in FIG. 1A. The moldboard assembly 30 includes a v-shaped moldboard 32 which has multiple functions, and the moldboard containment plate 37, as illustrated in FIG. 14. One function of moldboard 32 is to roll and mix the base material 33, as illustrated in FIG. 1A.

Figure 16:
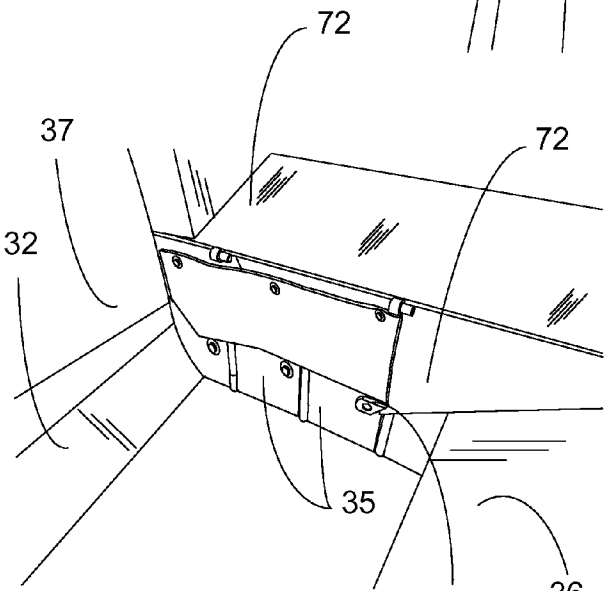
FIG. 16 illustrates a view of the adjustable moldboard extension plate assembly in a closed position and latched to the hopper of the spreader/paver apparatus of the present invention.

The second function is to move the base material 33 outward toward the moldboard extension plates 34, of extension plate assembly 35, as illustrated in FIGS. 1 and 16. The third function is to accurately strike off the base material 33 at a desired spread depth, width, and slope. The mixing action is also improved by the frontal hopper plate 36 which keeps the base material 33 flowing downward toward the v-shaped moldboard 32, as illustrated in FIGS. 1A and 16.

It should be kept in mind that the mixing action is very important. Other methods of handling base material on construction sites causes the base material to lose some key elements, such as moisture and mixture, of the base material, both of which are needed and often specified by construction engineers to build a long lasting road. The moisture and mixture helps to insure proper compaction and an overall stronger longer lasting road. One method that causes the base material to lose the key elements involves the base material being transported to the site ahead of time and stockpiled. Since it is stockpiled the material has to be handled multiple times by machines to load and move the material as it is needed. The more the material is handled the more moisture it loses and it also can become segregated. The solution this invention offers to that method is no need to stockpile and handle the base material multiple times, since the base material is dumped out of the truck directly into the hopper (as seen in FIG. 1) and spread before it loses the key elements of moisture and mixture. The mixing action also functions to prevent any such material segregation.

Turning now to the moldboard assembly 30, the assembly 30 includes a rear support beam 38, which is illustrated in FIG. 4. Attached to the rear support beam 38 are support guides 40 and hydraulic cylinders 42 which give the moldboard assembly 30 its vertical movement and stability, as seen in FIG. 4. The mold board assembly 30 can be removed from the gravel spreader 10 by unbolting mounting plates 44 and lowering the assembly 30 out the outer guide tubes 46, also shown in FIG. 4. Adjustable strike-off plates 48 are bolted to the bottom edges of the v-shaped moldboard 32, as illustrated in FIG. 14. These strike-off plates 48 can be raised up higher in the center of the moldboard 32, therefore allowing the gravel spreader 10 to spread a crowned path, whereas the center of the path is spread at a thicker depth than the outer edges of the path.

Figures 21, 22, 23:
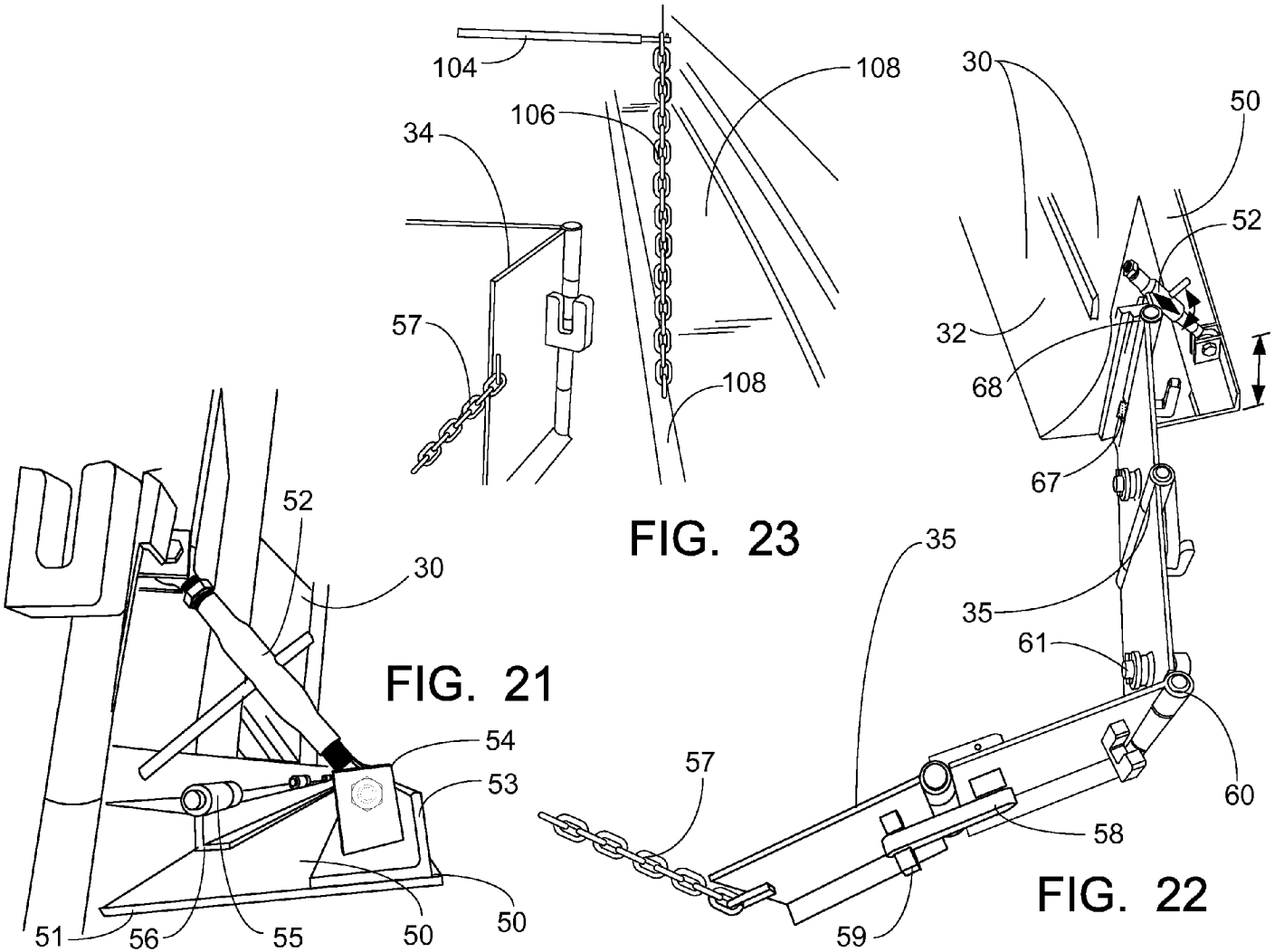
FIG. 21 illustrates a view of the screed assembly of the spreader/paver apparatus of the present invention.
FIG. 22 illustrates an additional view of the adjustable moldboard extension plate assembly as seen in FIGS. 19 and 20 of the spreader/paver apparatus of the present invention.
FIG. 23 illustrates views of the adjustable guide rod assembly of the spreader/paver apparatus of the present invention.

Reference is now made to the screed assembly 50, which is attached to the rear of the moldboard assembly 30, as illustrated in FIGS. 1A, 21, and 22. The assembly 50 comprises screed plate 51, plate reinforcement 53, adjustment bracket 54, hinge 55, and hinge support 56. The weight of the gravel spreader/paver apparatus 10 and base material 33 is redistributed to the ground by use of the adjustable screed assembly 50 The screed assemblies 50 ability to redistribute gives the rear of the gravel spreader 10 some support and stability as it rides on top of the base material 33. This support keeps the gravel spreader 10 spreading to a more consistent grade which makes fewer adjustments necessary by the machine's operator. The screed assembly 50 also compacts the base material 33 as it flows out the rear of the base spreader 10, as seen in FIG. 1A. The pitch of the screed assembly 50 can be adjusted by use of turnbuckles 52, also shown in FIGS. 1A and 21. Hydraulic and electric actuators, not illustrated, but known in the art, may also be used in place of the turnbuckles 52.

Figure 20:
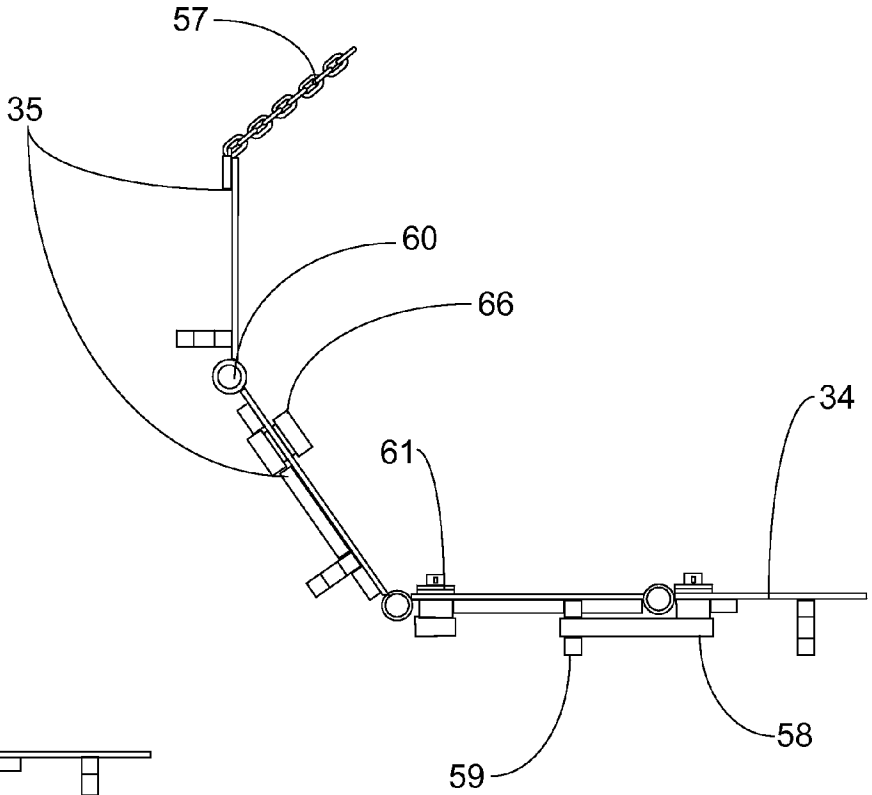
FIGS. 19 and 20 illustrate views of the adjustable moldboard extension plate assembly of the spreader/paver apparatus of the present invention.
Figure 19:
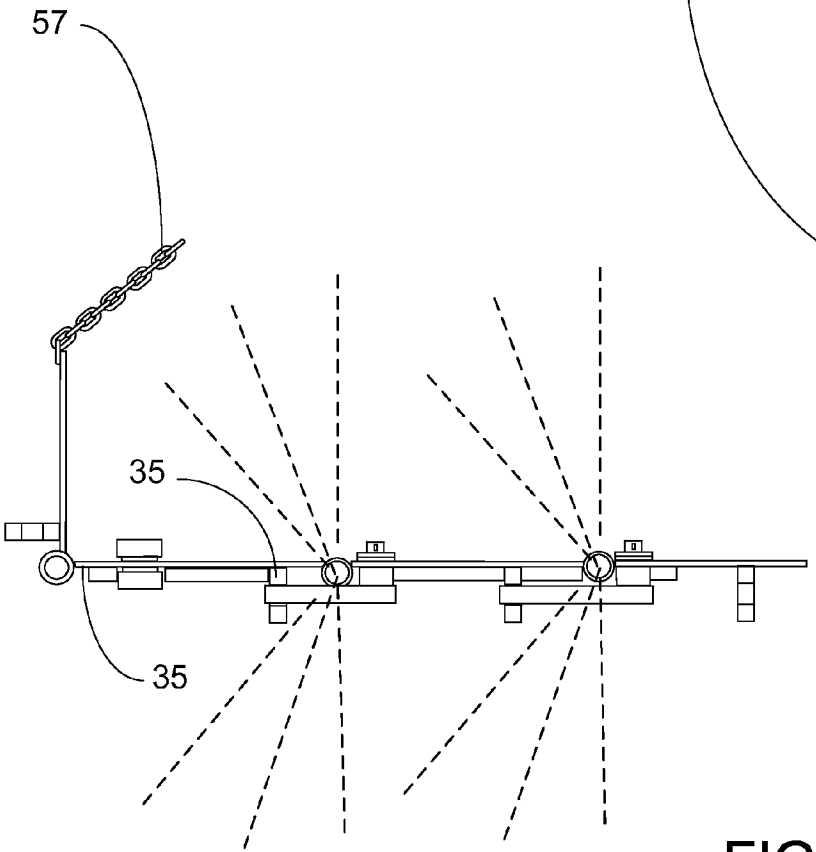

The gravel spreader 10 has two moldboard extension plate assemblies 35, as shown in FIGS. 1, 2, 19, 20 and 22. These assemblies 35 are attached to the outermost edges of the V-shaped moldboard 32 and move vertically with the moldboard assembly 30. One or more plate assemblies 35 can be extended to spread a path that is wider than the V-shaped moldboard 32. In order to gain the desired spread width, the extension plate assemblies 35 can be set into multiple configurations by use of the supporting chain 57 and multiple locking bars 58, locking bar brackets 59 and hinges 60, held by locking bar pins 61, as seen in FIGS. 19 and 20. The supporting chain 57 can be extended or retracted to give the extension plate assemblies 35 the needed pitch to feed the base material 33 outward away from the v-shaped moldboard 32, as shown in FIG. 22. The supporting chains 57 adjust within a slotted opening of the support chain anchor box 62. Anchor box 62 is attached to the framework 64 of the gravel spreader 10, as shown in FIG. 2. The extension plate assemblies 35 include latches 66 that allow the plate assemblies 35 to stay in a closed position for spreading more narrow paths which may not require extending the plate assemblies 35 to achieve the desired spread width. The latches 66 latch to the inside of the hopper 70, as shown in FIG. 16. The extension plate assemblies 35 have a vertical height spacer 67 which can be removed to allow one or more of the extension plate assemblies 35 to be set to spread base material 33 at a different spread depth than the moldboard assembly 30 is set at, as shown in FIGS. 2 and 22. This is particularly useful for spreading the outside shoulders of a path at a different depth than the path itself. This height spacer 67 is positioned on the hinge 68 that attaches the extension plate assembly 35 to the moldboard assembly 30, as seen in FIGS. 2 and 22, Reference is made once more to the hopper assembly 70, which is fixed rigidly to the framework 64 of the gravel spreader 10, as illustrated in FIG. 1. By redistributing the weight of the apparatus 10 and base material 33 onto the wheels 81, the hopper 70 allows the gravel spreader 10 to be operated by smaller machines with less horsepower, as seen in FIGS. 1 and 1A.

It is very important that the hopper 70 functions as a material transporter by carrying the base material until it is dispersed, therefor creating less resistance between the base material and the ground or sub-base by redistributing the weight of the base material to the wheels 81 of the apparatus 10.

Other base spreaders base spreaders shown in prior art comprise of an open three-sided box for confining and retaining the base material as its being dumped and spread without any means for transporting or redistributing the weight of said base material on ground engaging wheels. In addition, a large amount of base material is usually required to be dumped into or in front of the box to insure the spread has no voids or hollow spots and therefor a larger machine with greater horsepower is required to push and spread base material over the sub-base. The hopper 70 of the gravel spreader 10 requires less base material to accomplish this task by directing and concentrating the base material against the moldboard and sub-base therefor eliminating any possible voids (lose or empty spots within the base material) within the spread. It might also be said that the mixing action of the hopper 70 also helps to prevent any such voids or lose spots within the base material as shown in FIG. 1A.

Figure 5:
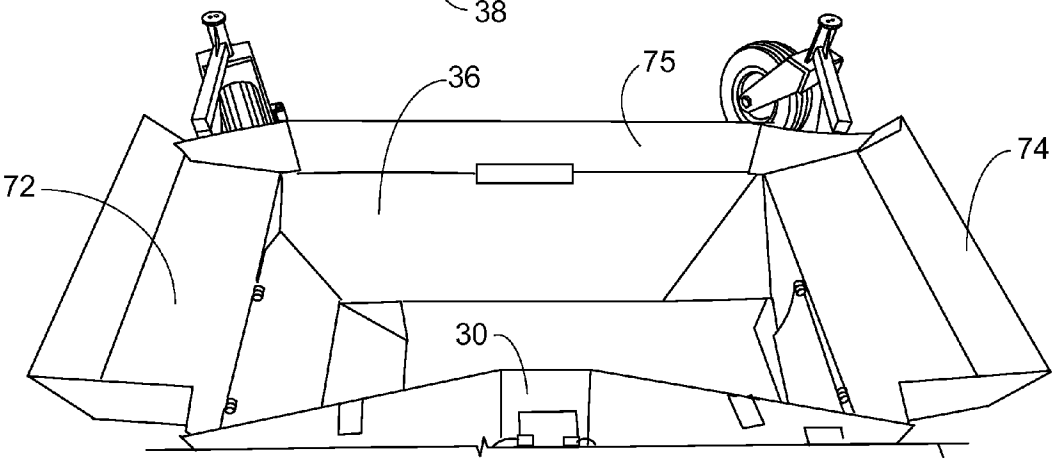
FIG. 5 illustrates an overall view of the hopper portion of the spreader/paver apparatus of the present invention.

The hopper 70, which includes inner hopper plate 72, frontal hopper plate 36, and outer hopper plate 74, also helps to insure the mixing of the base material 33 by directing the base material 33 inward towards the v-shaped moldboard 32, as shown in FIGS. 1A and 5. Another important function of the hopper 70 is to shield and protect the roll of geo-textile fabric 90 from the base material 33 being dumped into the gravel spreader 10, as seen in FIGS. 1 and 1A.

Without the hopper 70 acting as a shield, it would be very difficult, perhaps even impossible, for the apparatus to install the geotextile fabric 90. The fabric must be in position either in front of where the base material is being dumped, or directly underneath, to avoid direct contact with any wheels or tracks of any machine. Since the wheels of the dump truck 14 engage against the gravel spreader 10 there is no practical means of placing the roll of fabric 90 between the dump truck 14 and gravel spreader apparatus 10. Therefore the fabric roll 90 must be placed under the hopper 70. Positioning fabric 90 under the hopper 70 also insures that no wheels or tracks come into contact with the fabric 90 until it has had the base material spread over it. Therefore, the apparatus 10 would have to include a hopper 70, or shield of some sort, to accomplish the fabric installing capabilities.

The hopper 70 also allows for the cutoff plate inserts 102 to be used. Inside the hopper 70, the plates 102 attach inside the hopper 70 and serve as a secondary hopper within the main hopper 70 by directing the material into a more concentrated area. These cutoff plates 102 reduce the size of the hopper opening into which the base material flows and serve as a small spreader type box within the apparatus, therefore allowing the apparatus to spread a more narrow path as seen in FIG. 14. Although FIG. 14 shows only two of the inserts 102 on one side of the apparatus 10, it should be made clear that the opposite side could also be configured with these inserts 102.

The hopper 70 has a flexible containment baffle 75, as shown in FIG. 2, to prevent the base material 33 from spilling out between the gravel spreader 10 and the dump truck 14. If any base material 33 does inadvertently spillover the containment baffle 75, the adjustable spillover blade 77, shown in FIGS. 1A and 13, will function to push and spread the spilled base material 33. This is particularly useful when the gravel spreader 10 is being used as a combination base spreader and geo-textile fabric installer by reducing the amount of base material 33 that ends up between the geo-textile fabric 90 and the sub-base 100, as shown in FIGS. 1 and 1A.

As seen in FIGS. 14, 15, 17, and 18, there are provided upper and lower cut-off plate inserts 102 that can be latched into the hopper assembly 70 to reduce the width of the spread. One or more of these inserts 102 may be used to configure the gravel spreader 10 to spread a path that is narrower than the v-shaped moldboard 32. The ability to spread narrow paths is particularly useful in bike path construction.

Figures 12, 13:
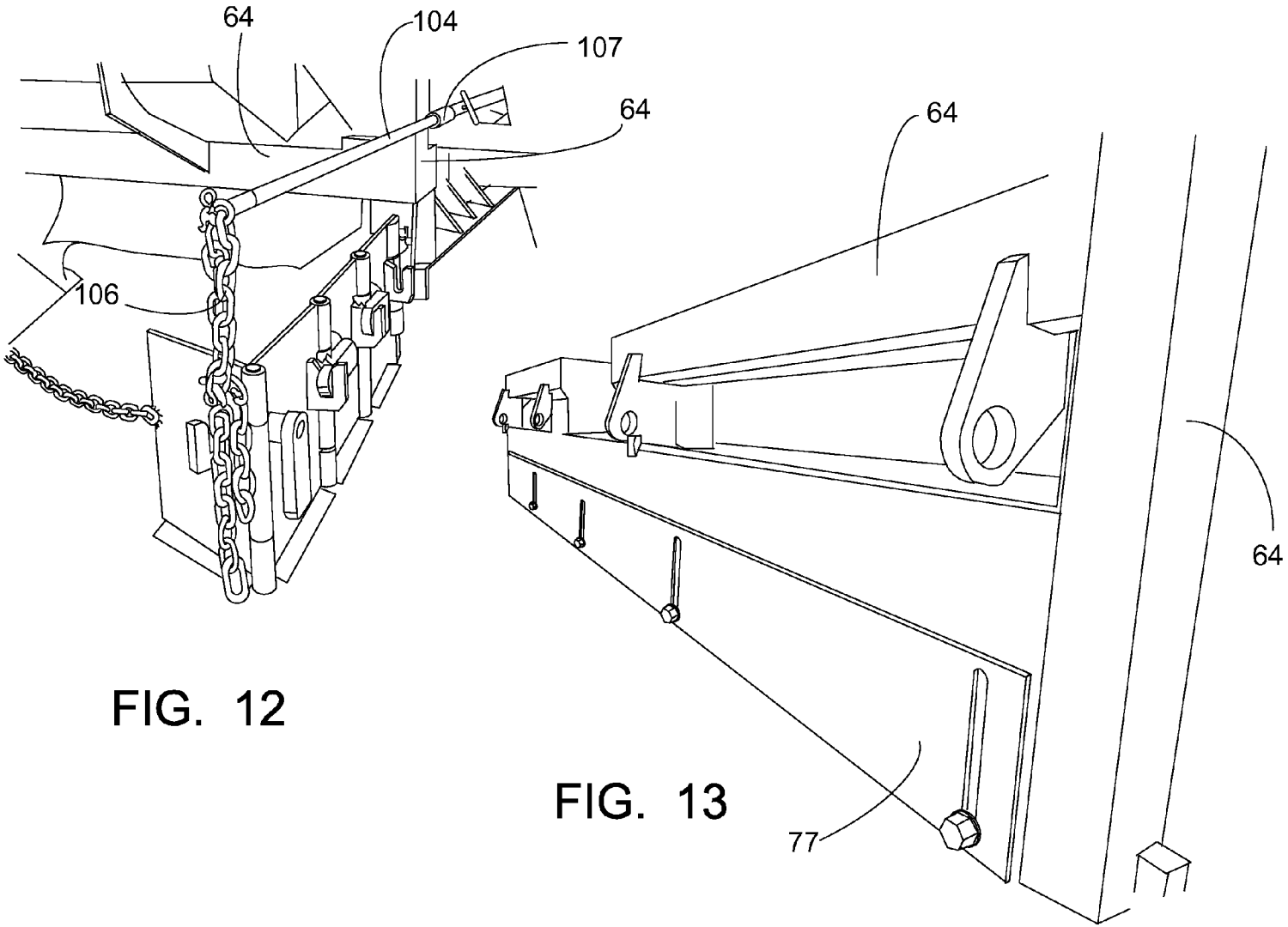
FIG. 12 illustrates a view of the adjustable guide rod assembly of the spreader/paver apparatus of the present invention.
FIG. 13 illustrates a view of the adjustable spillover plate and push roller bracket of the spreader/paver apparatus of the present invention.

Reference is now made to the adjustable guide rod 104 and guide rod chain 106 which can function both as a steering guide and also as a grade gauge, as seen in FIGS. 12 and 23. The guide rod 104 is inserted through adjustment bracket 107 which is located on the rear of the framework 64 of the gravel spreader 10, as shown in FIG. 12. The guide rod 104 can be extended outward away from the gravel spreader 10 therefore giving the operator a direct line of sight of the rod 104 and chain 106. The chain 106 can be adjusted vertically to drag the top of a curbing or work surface 108, as shown in FIG. 23. The operator would be able to gauge if the gravel spreader 10 is maintaining the proper grade if the distance between the chain 106 and surface 108 changes. The rod 104 and chain 106 can be used as a steering guide by following pre-installed curbing or paint marking, also shown in FIG. 23.

Figure 9:
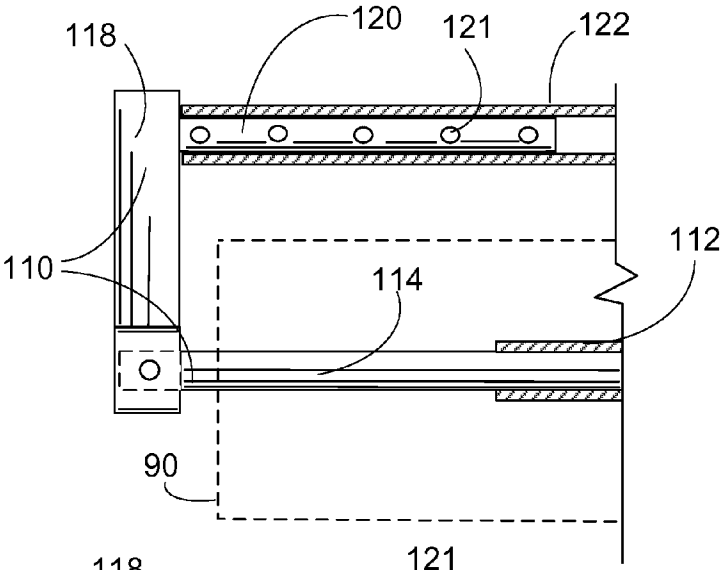
FIG. 9 illustrates a rear view of the retracted fabric roller assembly of the spreader/paver apparatus of the present invention.
Figure 10:
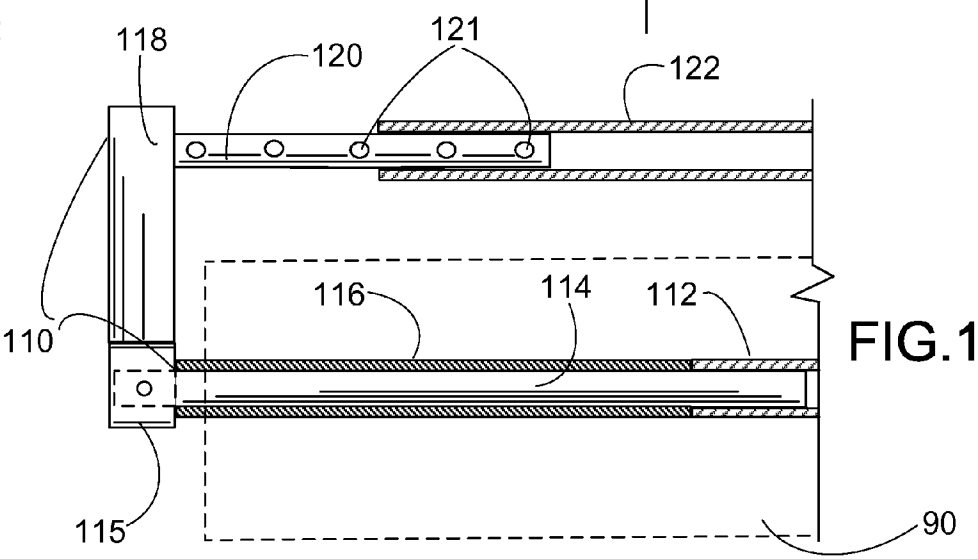
FIG. 10 illustrates a rear view of the extended inner and outer roller axle tubes and the adjustment tubes of the spreader/paver apparatus of the present invention.
Figure 8:
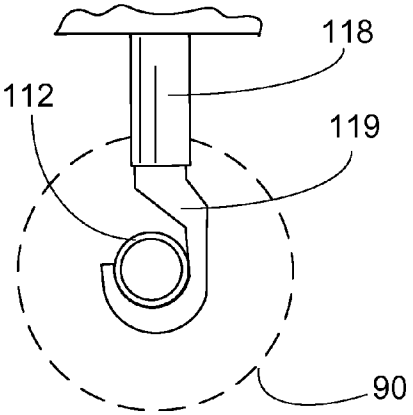
FIG. 8 illustrates a side view of the fabric roller assembly of the spreader/paver apparatus of the present invention.
Figure 11:
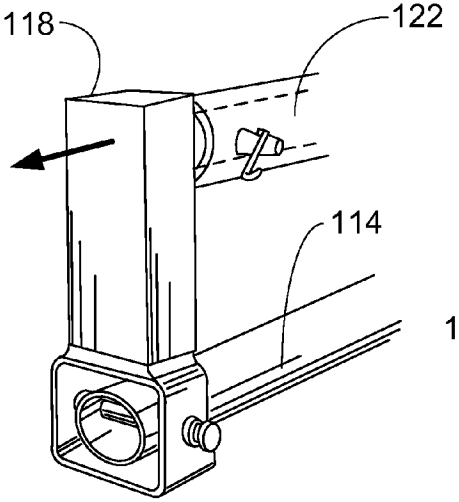
FIG. 11 illustrates an end view of the fabric roller adjustment bracket supported by the vertical support tube of the spreader/paver apparatus of the present invention.

Reference is now made to the fabric roller attachment 110 which gives the gravel spreader 10 the ability to disperse and install geo-textile fabric 90 while simultaneously spreading base material 33 over the fabric 90, as seen more clearly in FIGS. 1 and 1A. This attachment 110 comprising a two piece telescopic axle 112 and 114, as shown in FIGS. 9 and 10, which can be extended or retracted to fit various width rolls of fabric 90. There are also provided axle attachment brackets 115 and axle attachment hooks 119. When extended, there are provided multiple fabric roller spacer inserts 116, as shown in FIG. 10, which slide over the inner axle tube 114. These inserts 116 keep the two piece fabric axle 112 and 114 from retracting as it is slid through the roll of fabric 90. When not in use, the spacer inserts 116 can be attached to hanger bracket 117 which is located on the outside of the outer hopper plate 74, as shown in FIG. 2. Each vertical support tube 118 of the fabric attachment 110 includes a horizontal adjustment tube 120 welded to it. These Adjustment tubes 120 attach to the fabric roller brackets 122, which allow the fabric roller attachment 110 to be extended or retracted to fit various width rolls of fabric 90, as shown in FIGS. 9 and 10. These adjustment tubes 120 have multiple adjustment holes 121 and slide inside of fabric roller attachment bracket 122 which is located underneath the frontal hopper plate 36, as shown in FIG. 2. The location of the fabric roller attachment 110 is very critical. This location insures the fabric 90, of which the gravel spreader 10 is installing, never has any direct contact with any wheels or tracks of any machine whatsoever. Road specifications normally require that no wheels or tracks of any machine or truck make direct contact with the geo-textile fabric 90. A machine can only travel across the spread path after the fabric 90 has had base material 33 placed on top of it.

Figure 3:
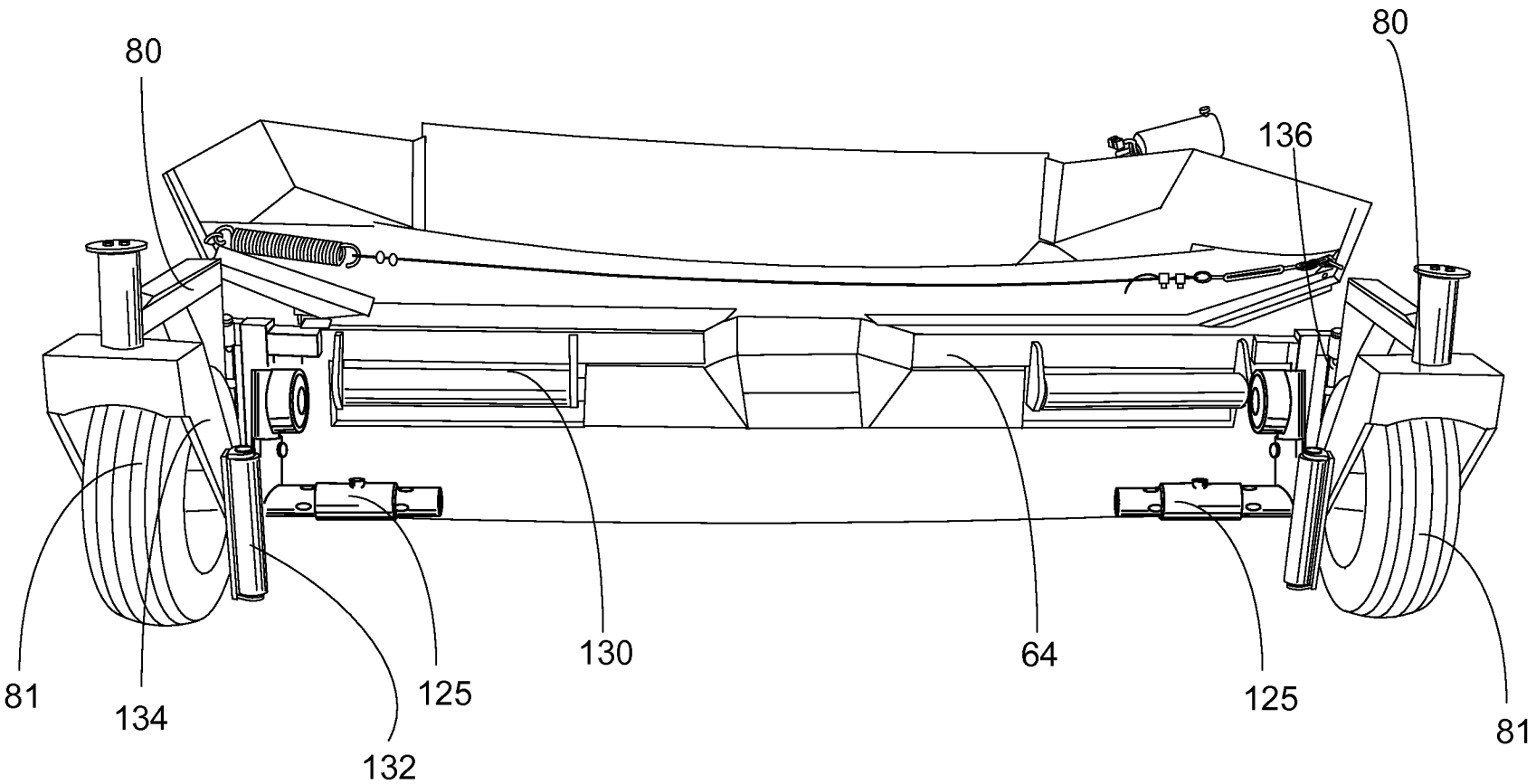
FIG. 3 illustrates of front view of the spreader/paver apparatus of the preferred embodiment of the apparatus of the present invention.

As seen in FIG. 3, there is provided a push roller assembly 130, as shown in FIG. 3, which rides against the rear wheels 15 of the dump truck 14, as shown in FIG. 1A, as the gravel spreader 10 is being operated. While in operation, the operating machine 129 gives the gravel spreader 10 and dump truck 14 their forward momentum and motion for intended operation. This action gives the operator of machine 129 control of the overall speed of the spread and insures that the dump truck 14 is dumping the base material 33 into the hopper 70 of the gravel spreader 10. The adjustable wheel assemblies 80, which support wheels 81, have guide rollers 132, attached vertically to the lower inside of wheel arm forks 134, supported by wheel arms 135, on outer wheel adjustment tubes 136, as shown in FIGS. 2 and 3. These rollers 132 insure that the dump truck 14 and gravel spreader 10 are traveling in a preferred direction or path by making contact with the outer surface of the rear wheels 15 of the dump truck 14 should it travel off course, as shown in FIG. 1A.

As further illustrated in FIG. 3, the gravel spreader/paver apparatus 10 would further include wheel locks 125 attached to the apparatus 10, so that when an operator would utilize a dump truck 14, or similar machine, the wheel lock assemblies 125 would be used to attach the gravel spreader/paver apparatus 10 to the dump truck 14, or similar machines, therefore allowing dump truck 14 to provide the gravel spreader/paver apparatus 10 the needed motion and power intended for operation and use as described.

Operation of the Apparatus

Figure 7:
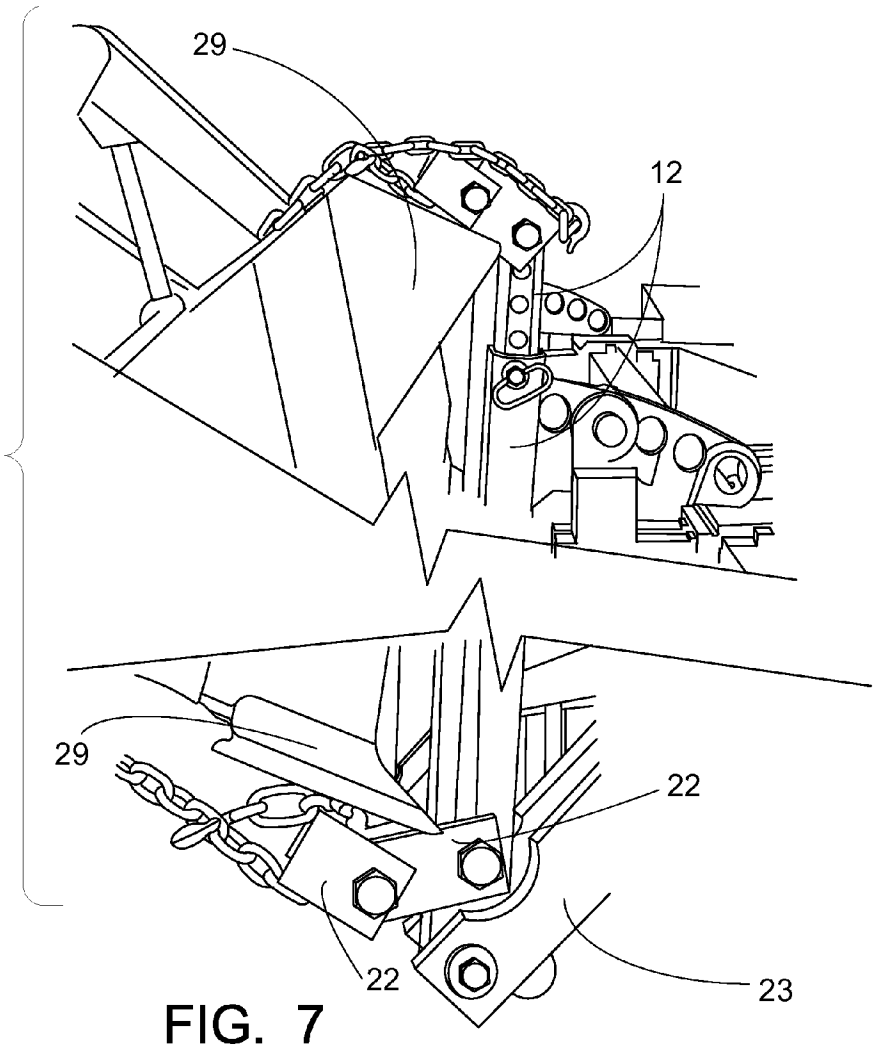
FIG. 7 illustrates a partial view of the hitch assembly of the spreader/paver apparatus of the present invention.
Figure 6:
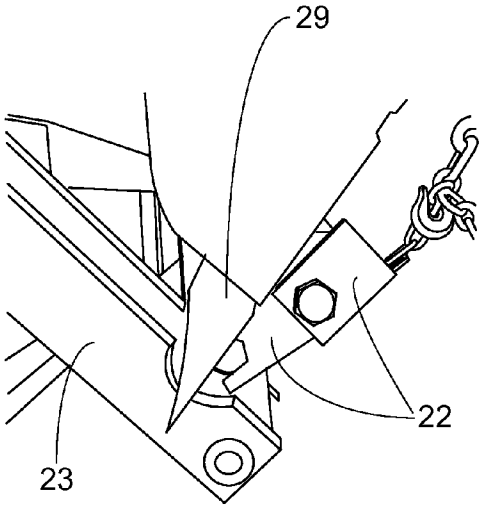
FIG. 6 illustrates a view of the lower hitch bracket of the spreader/paver apparatus of the present invention.

As seen in FIGS. 1-23 discussed, above, the gravel spreader apparatus 10 includes the universal hitch assembly 12 which allows a wide variety of machinery 129, such as a bulldozer or wheel loaders, to attach to and operate the gravel spreader 10. Most machines with a bucket or dozer blade 29 can attach to these brackets. The brackets wrap around the blade or bucket 29 and serve as a clamp devise once chains and binders are hooked into the brackets. As seen in FIG. 7, when not in use, the three spacer inserts 116 are attached to the side of the spreader apparatus 10. As seen in FIG. 10 these inserts 116 are used when the fabric roller bracket 122 is extended for various width rolls of geo-textile fabric 90. FIG. 4 shows the rear of the v-shaped mold board 32 of assembly 30. The spreader apparatus 10 includes an electric hydraulic pump 122A to adjust the mold board assembly 30, although it is foreseen that there may be included other means for movement such as: mechanical, manual, or electric actuator. FIG. 12 shows the adjustable guide rod 104 and chain 106. The guide rod 104 can be extended to various locations to achieve a direct line of sight for operator, and the operator can use this to determine whether the depth of the spread may need adjusting. The guide rod 104 and chain 106 can also be used as a steering guide to follow curbing or painted markings. The paint markings would be sprayed on the work surface before the spreader apparatus is operated. The chain 106 can be set to ride right above the ground or curb and would indicate if the spread depth needs adjusting if the distance between the chain and curb or ground changes.

FIG. 22 shows the v-shaped mold board assembly 30. The assembly 30 includes the v-shaped mold board 32, adjustable screed assembly 50 and extension plate assemblies 35. The moldboard assembly 30 can be adjusted vertically in the spreader apparatus to set the spread depth. The v-shaped design of the moldboard 32 directs the base material 33 outward towards the extension plate assemblies 35. Also, this moldboard 32, in conjunction with the hopper 70 helps to prevent material segregation and moisture loss by creating a mixing and rolling action as seen in FIG. 1A. Moisture is needed for proper compaction of base material 33, and therefore keeping the moisture content in the material 33, would eliminate the costly expense of needing water trucks to spray the material 33 to replace the moisture, therefore making the overall process more efficient. The v-shaped moldboard assembly 30 moves vertically within the fabric spreader apparatus 10. When the moldboard assembly 30 moves, so does the adjustable screed 50 and extension plate assemblies 35. The adjustable extension plate assemblies 35 can be left shut for narrow paths. For wider paths, one or more plate assemblies 35 can be opened and set to the desired width by use of supporting chains 57 and multiple hinges 60 and locking bars 58. Also, the plate assemblies 35 can be angled back to help feed the base material 33 outward away from the moldboard 32. The adjustable plate assemblies 35 contain height adjustments by use of vertical height spacers 67. These vertical height spacers 67 allow the spreader apparatus 10 to be configured to spread base material 33 on a path or roadway at one depth while spreading the shoulders at a different depth. Both extension plate assemblies 35 can be configured to spread two shoulders simultaneously, or one assembly 35 can be configured to spread one shoulder per pass. It is foreseen that the adjustment is made manually, but it will also be possible by other means such as: mechanically or by electric or hydraulic actuator. As seen in FIG. 1A, The adjustable screed 50 redistributes the rear weight of the spreader apparatus 10 and the base material 33 to the ground. The weight redistribution performed by the screed 50 serves two functions. One of which is to give the base material 33 some compaction. The second function is to help insure the fabric spreader apparatus 10 is spreading to an accurate grade and depth. This screed 50 acts like a ski and rides on top of the base material 33 giving the fabric spreader apparatus 10 stability and makes less adjustments necessary by the gravel spreader's operator. The adjustments of screed 50 will be able to be made mechanically or by electric or hydraulic actuator.

Figure 15:
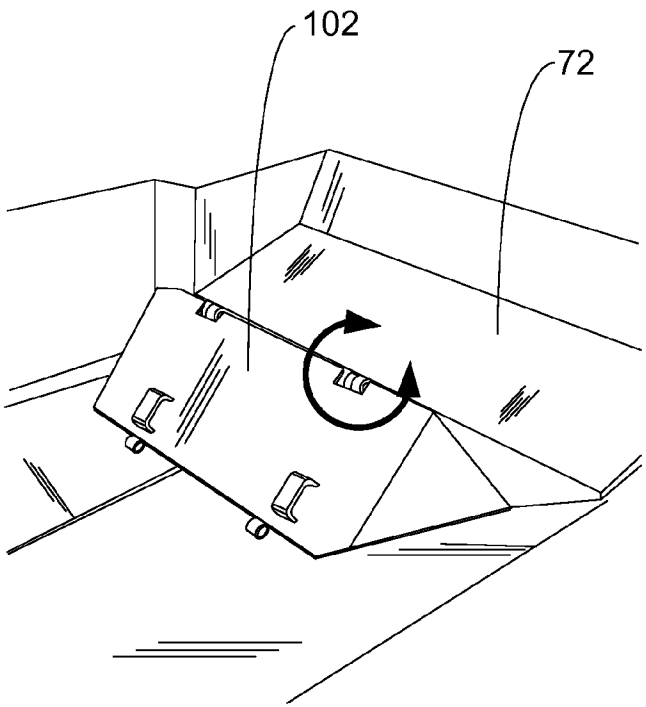
FIG. 15 illustrates views of the upper cutoff plate insert and inner hopper plate of the spreader/paver apparatus of the present invention.

FIGS. 14 and 15 illustrate the upper and lower cut-off plate inserts 102. These cut-off plates 102 allow the spreader apparatus 10 to spread narrow paths and can be inserted into multiple configurations to achieve the desired spread width. One or more of these can be inserted into the hopper 70 of the fabric spreader apparatus 10. The cutoff plates inserts 102 have a particular function in which using the inserts allow the fabric spreader apparatus 10 to be configured to spread very narrow paths, such as bike paths. The spreader apparatus 10 can also install geo-textile fabric 90 while spreading narrow paths when fabric 90 is required. The adjustable wheel assemblies 80 are placed in an inward an outward position. One or both assemblies 80 can be positioned inward or outward and can be adjusted to different heights in order to configure the fabric spreader apparatus 10 into the desired configuration. The geo-textile fabric roller attachment 110 adjusts to different widths. Either attachment 110 may be extended or retracted for different length rolls of geo-textile fabric 90. When extended for wide rolls of fabric 90, one or more of the spacer inserts 116 would be placed over the fabric roller axle 112 and 114. The adjustable blade 77 located on the front of the gravel spreader 10 plows away and spreads any possible spillover of the base material 33 being dumped into the spreader apparatus 10, as seen in FIG. 1A. This is very important to protect the roll of fabric 90 and to insure that the spread meets engineer's specifications. FIG. 1A shows the spreader apparatus installing geo-textile fabric 90 while spreading the base material 33, but the spreader apparatus 10 can also be used a base spreader without installing fabric 90 whenever geo-textile fabric 90 is not required. The design of the hopper 70 of the fabric spreader apparatus 10 serves multiple functions. One of which is to shield and protect the roll of fabric 90 from the base material 33 being dumped. Second of which is to carry some of the weight of the material 33 being dumped into the hopper, therefore requiring less horsepower to operate the spreader apparatus 10. The third function is to work in conjunction with the v-shaped mold board 32 to prevent segregation of material 33.

The following is a list of parts and materials suitable for use in the present invention:

PARTS LIST

| NUMBER | DESCRIPTION |
|---|---|
| 10 | gravel spreader/paver apparatus |
| 12 | universal hitch assembly |
| 14 | dump truck |
| 15 | rear wheels |
| 16 | pins |
| 18 | vertical adjustment tube |
| 20, 22 | upper and lower hitch brackets |
| 23 | vertical support tube bracket |
| 24 | adjustment bracket |
| 25 | vertical support tube |
| 26 | locking pin |

-continued

| PARTS LIST | |
|---|---|
| NUMBER | DESCRIPTION |
| 28 | locking bracket |
| 29 | bucket or blade |
| 30 | adjustable mold board assembly |
| 33 | base material |
| 32 | V-shaped mold board |
| 34 | mold board extension plates |
| 35 | plate assembly |
| 36 | frontal hopper plate |
| 37 | mold board containment plate |
| 38 | rear support beam |
| 40 | support guides |
| 42 | hydraulic cylinders |
| 44 | mounting plates |
| 46 | outer guide tubes |
| 48 | strike off plates |
| 50 | screed assembly |
| 51 | screed plate |
| 52 | turn buckles |
| 53 | plate reinforcement |
| 54 | adjustment bracket |
| 55 | hinge |
| 56 | hinge support |
| 57 | supporting chain |
| 58 | locking bars |
| 59 | locking bar brackets |
| 60 | hinges |
| 61 | bar pin |
| 62 | support chain anchor box |
| 64 | frame work |
| 66 | latches |
| 67 | vertical height spacers |
| 68 | hinge |
| 70 | hopper assembly |
| 72 | inner hopper plate |
| 74 | outer hopper plate |
| 75 | containment baffle |
| 77 | adjustable spillover blades |
| 80 | wheel assembly |
| 81 | wheels |
| 90 | geotextile fabric |
| 100 | sub-base |
| 102 | cut-off plate insert |
| 104 | adjustable guide rod |
| 106 | guide rod chain |
| 107 | adjustment bracket |
| 108 | curbing or work surface |
| 110 | fabric roller attachment |
| 112, 114 | two-piece telescopic axle |
| 115 | axle attachment brackets |
| 116 | roller spacer inserts |
| 117 | hanger bracket |
| 118 | vertical support tube |
| 119 | axle attachment hooks |
| 120 | horizontal adjustment tube |
| 121 | holes |
| 122 | fabric roller brackets |
| 122A | hydraulic pump |
| 125 | wheel locks |
| 129 | operating machine |
| 130 | push roller |
| 132 | guide rollers |
| 134 | wheel arm forks |
| 135 | wheel arms |
| 136 | outer wheel adjustment tubes |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A gravel spreader and paver apparatus for transporting and spreading base material, including gravel, asphalt, limestone, dirt, or sand, onto a surface, comprising:

an attachment means on a forward portion of the apparatus enabling attachment to a first separate machine;

an attachment means on a rear portion of the apparatus, comprising horizontal pitch adjustment means and vertical adjustment means, wherein the attachment means enables attachment of the apparatus to a second separate machine for operating and providing forward movement to the apparatus;

a wheel assembly comprising one or more wheels;

a hopper portion, for receiving base material from the first separate machine and for transporting the base material, wherein the hopper portion is also for delivering base material onto the surface while the apparatus is moving forward;

the hopper portion defining a means to redistribute weight of the base material onto the one or more wheels of the wheel assembly for creating less resistance between the base material and the surface;

an adjustable moldboard comprising a spreading means mounted on the apparatus for spreading the base material onto a surface to a pre-determined, precise depth; the adjustable moldboard being vertically adjustable and adjustable into multiple positions, to control amount, depth, slope, and width of the material being spread; and adjustable extension plates attached to the adjustable moldboard for allowing the base material to be spread at one or more widths larger than the adjustable moldboard.

2. The apparatus in claim 1, further comprising a fabric roller assembly including a roll of geo-textile fabric, for unrolling the geo-textile fabric onto the surface while the apparatus is in motion, the unrolled geo-textile fabric for receiving base material from the hopper portion while the apparatus is in motion.

3. The apparatus in claim 1, wherein the attachment means on the forward portion of the apparatus enables attachment to a dump truck for delivering the base material to the hopper.

4. The apparatus in claim 1, wherein the attachment means on the forward portion of the apparatus enables attachment to a rear portion of a dump truck so that the hopper may receive the base material from the dump truck while in motion.

5. The apparatus in claim 4, wherein the attachment means on the rear portion of the apparatus, enables attachment to a skid steer, for enabling forward motion of the apparatus and dump truck.

6. The apparatus in claim 1, wherein the attachment means on the forward portion of the apparatus enables attachment to a dump truck, for providing base material to the hopper while the apparatus is in motion and also for providing forward motion to the apparatus.

7. The apparatus in claim 1, wherein the adjustable attachment means on the rear portion of the apparatus comprises adaptable mounting plates and brackets for enabling attachment to a skid steer, back hoe, dozer, truck, wheel loader or dump truck.

8. The apparatus in claim 1, further comprising more than one adjustable moldboard able to adjust into multiple positions, heights, angles and widths, which gives an operator control of amount, depth, slope, and width of the material being spread.

9. The apparatus in claim 1, wherein the apparatus is operable by manual hydraulic, mechanical/electrical actuator, mechanical or pneumatic power means.

10. The apparatus in claim 1 further comprising adjustable spreader boxes extending out one or more sides of the apparatus adjustable to various widths and heights.

11. The apparatus in claim 1, further comprising one or more adjustable screeds to come into contact with the base material being spread after the base material has been ejected from the hopper in order to redistribute weight from the hopper to the surface, for providing compaction to the base material.

12. The apparatus in claim 1, further comprising wheel locks attached to the apparatus.

13. The apparatus in claim 1, wherein the apparatus is transportable by equipment trailers, or trucks.

14. The apparatus in claim 1 wherein the adjustable moldboard is v-shaped.

* * * * *